United States Patent [19]

Moehling et al.

[11] Patent Number: 4,637,319

[45] Date of Patent: Jan. 20, 1987

[54] BOLSTER FRICTION SHOE POCKET

[75] Inventors: Charles Moehling, Arlington Heights; James A. Henkel, Park Forest, both of Ill.

[73] Assignee: Amsted Industries Incorporated, Chicago, Ill.

[21] Appl. No.: 677,390

[22] Filed: Dec. 3, 1984

[51] Int. Cl.[4] ..... B61F 5/40

[52] U.S. Cl. ..... 105/207; 105/226

[58] Field of Search ..... 105/207, 206 R, 197 R, 105/197 D, 197 DB, 198, 226

[56] References Cited

U.S. PATENT DOCUMENTS 2,237,953 4/1941 Webb ..... 105/207 X
3,408,955 11/1968 Barber ..... 105/207 X
3,802,353 4/1974 Korpics ..... 105/207 X
4,084,513 4/1978 Bullock ..... 105/207 X

OTHER PUBLICATIONS

*Standard Handbook for Mechanical Engineers,* Baumeister & Marks, McGraw Hill, 7th Edition, pp. 5–21 to 5–23.

*Primary Examiner*—David A. Scherbel
*Assistant Examiner*—Glenn B. Foster
*Attorney, Agent, or Firm*—Edward J. Brosius; Charles E. Bouton

[57] ABSTRACT

A railway vehicle truck friction shoe pocket including a sloped wedge wall and longitudinally spaced depending walls of which at least one of the inner planar faces is provided with one or more relieved sections.

2 Claims, 8 Drawing Figures

BOLSTER FRICTION SHOE POCKET

FIELD OF THE INVENTION

This invention relates to snubbed railroad car trucks and more particularly to a friction shoe pocket for accommodating a friction shoe therein.

SUMMARY OF THE INVENTION

It has been conventional practice to provide snubbed trucks with friction shoe pockets in which friction shoes are guided to wedge against a sloping surface of said pockets and to bear against a friction surface provided on walls adjoining said pockets.

In one type of such a snubbed truck, the friction shoe is urged into wedge engagement with a friction shoe pocket sloping surface and into frictional engagement with a column friction surface by a side frame mounted shoe actuating spring which also supports the bolster. This type of truck is known as a variable friction truck because the compression of the shoe actuating spring varies during relative vertical motion between the side frame and the bolster.

Undesireable wear along a wall defining the outboard side of the friction shoe pocket may occur in such a truck as the shoe rubs against the wall during relative movement between the side frame and bolster. Such wear may create a condition which causes the shoe to hang-up or lock-up thereby preventing its retraction into the pocket as a result of the action of motion, and associated forces, between the side frame and bolster. Such lock-up causes these forces to be transmitted by the shoe into the sloped section of the pocket thereby creating excessive stress conditions which may result in the formation of fatigue cracks and eventual failure of the slope section and the surrounding structure.

One arrangement proposed to solve this problem uses a wearplate having one wall seated against the pocket sloping surface and having two other walls seated against the inboard and outboard pocket walls defining the extremities of the sloping surfaces. It is recognized that wearplates become loose in service thereby to create a condition which may result in malfunctioning of the truck. In addition, such a solution adds extra parts and cost to the truck.

It has been discovered that one of the problems resides in the formation of one or more protrusions or ledges on the inner surface of the upstanding walls of the friction shoe pocket. A pin hole is adapted to receive a pin extending through an enlarged hole of the shoe to hold it in retracted position during assembly or servicing of the truck. In service, the shoe wears the pocket outboard wall in the area of its pin hole until a protrusion is formed. The protrusion limits shoe retraction into the pocket under the action of motion between the bolster and the side frame and thus against the shoe, such retraction being necessary to transfer the associated forces to the bolster and side frame areas designed to withstand such loads. As a result, the forces imposed by the side frame against the shoe may cause damage to the pocket slope and its surrounding structure.

Another type of truck in which the uneven wear may occur between counteracting or mating surfaces of the truck components and friction shoe is the constant friction truck. In this type of the truck, springs mounted in the bolster yieldingly supports the friction shoe. Wear of the shoe engaging surface in this type of truck may result in the formation of a protuberance about a pin hole on the inboard face of the outboard side wall of the pocket. The protuberance may limit movement of the shoe within the pocket, such movement being necessary to allow translation and rotation of the side frame as the truck's wheel and axle sets traverse track irregularities.

Similar wear problems may arise when the friction shoe pocket is formed in the side frame rather than bolster as described above.

Accordingly, it is a primary object of the invention to provide a friction shoe pocket structure which eliminates formation of such ledges and/or protrusions.

Another object of the invention is to provide a contour for the engaging surfaces of friction shoe pocket wall and the shoe, so as to reduce the wear which may result in hang-up of the friction shoe.

Generally the present invention comprises a railway vehicle truck friction shoe pocket with a friction shoe therein. The friction pocket includes a sloping wedge wall to provide a wedge seat for the friction shoe. A first upstanding wall and a lengthwise spaced upstanding second wall extend from the wedge wall. At least one of the inner surfaces of one of the walls is provided with reliefs or recesses located in the path of movement of one or more edges of the friction shoe so as to prevent the formation of protuberances projecting into said pocket.

DESCRIPTION OF THE PREFERRED EMBODIMENT

Figure 1:
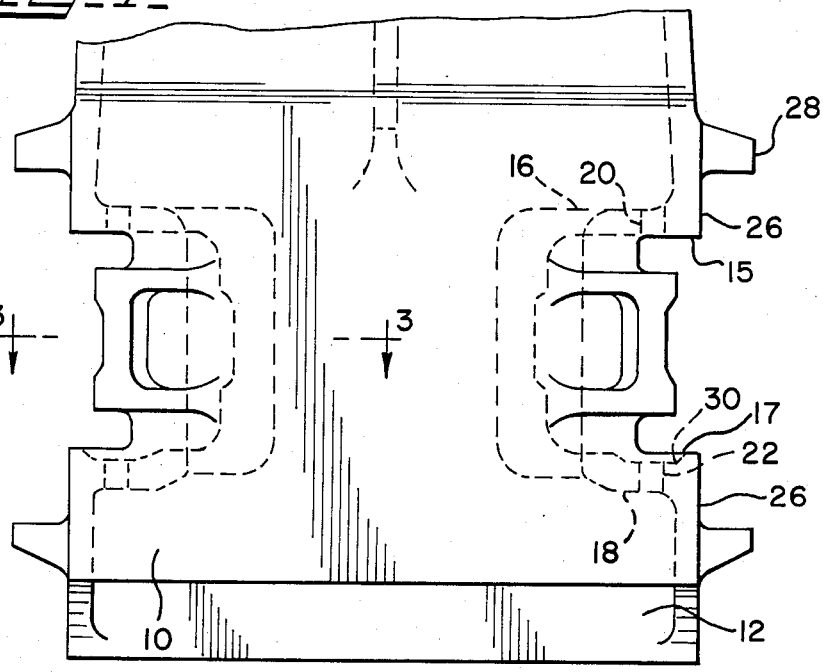
FIG. 1 is a top plan view of a variable friction bolster embodying a preferred form of the invention.
Figure 2:
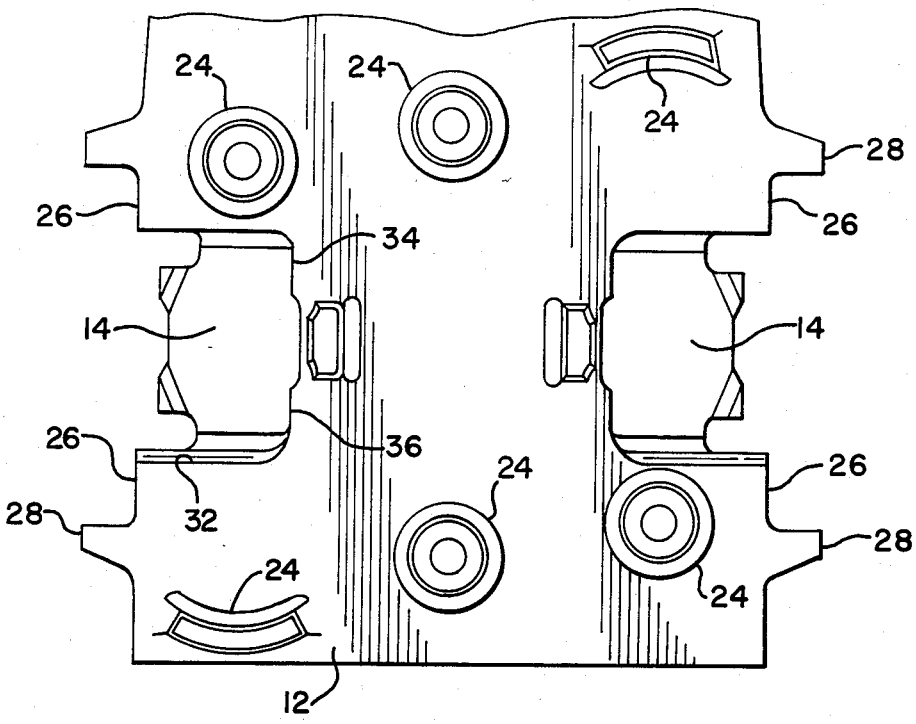
FIG. 2 is a bottom plan view of the bolster shown in FIG. 1.
Figure 4:
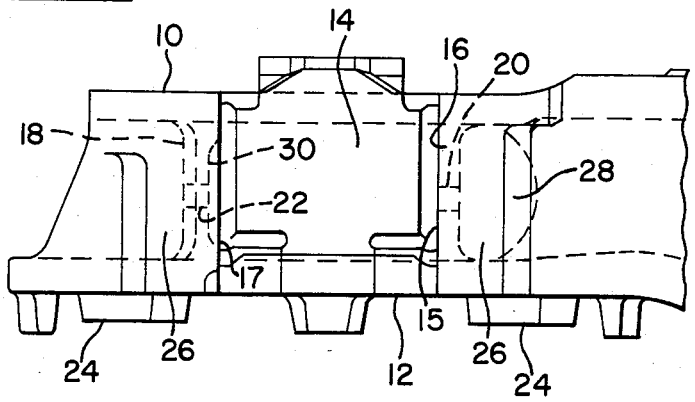
FIG. 4 is a side elevational view taken from the right as seen in FIG. 1.
Figure 3:
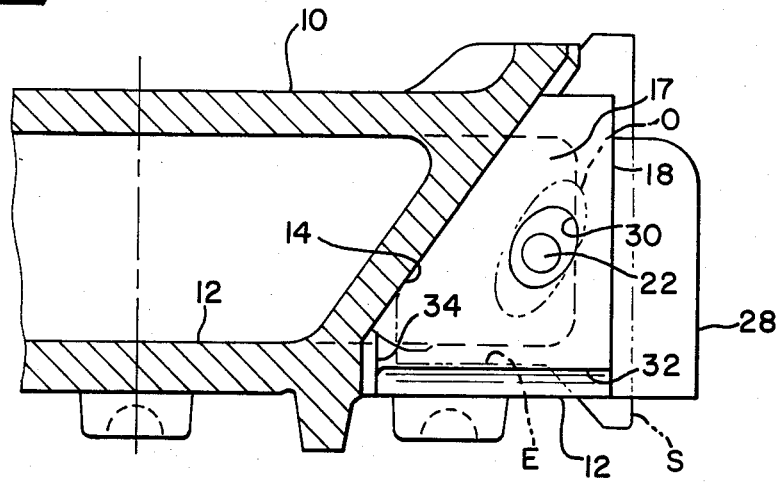
FIG. 3 is a sectional view of the friction shoe pocket taken generally along the line 3—3 of FIG. 1; and showing a friction shoe in phantom mounted therein.

Referring now to FIGS. 1–4 of the drawing, the friction shoe pocket of the present invention is shown applied to a variable friction bolster. The bolster comprises top and bottom walls 10 and 12 and a sloping wedge wall 14 at each side thereof defining a friction shoe pocket with upstanding inboard and outboard pocket walls 16 and 18, respectively, which have pin holes or apertures 20 and 22, respectively, for reception of a pin (not shown) which extends through an aperture O of a friction shoe S to hold it in retracted position within the friction shoe pocket against the wedge wall 14 during assembly or servicing of the truck. The wall 14 may be provided with a wearplate (not shown). The upstanding walls 16 and 18 are each provided with opposing inner planar faces 15 and 17, respectively.

Under service conditions the bolster is supported directly by springs (not shown) which are located by lugs 24 depending from the bottom wall 12 of the bolster, and each friction shoe is supported by shoe actuating springs (not shown). The springs are supported in the conventional manner by a side frame (not shown) which has columns with friction surfaces engaged by the shoes S which seat against the pocket wedge walls 14 and thus also support the bolster.

As the truck rolls along the track the bolster oscillates relative to the side frame columns in a manner which can cause each friction shoes S to engage the planar surface 17 of outboard wall 18 of its friction shoe pocket. Under such conditions oscillation of the bolster between the side frame columns moves the shoes S into and out of their respective pockets. In prior art arrangements such oscillation after service of the order of 200,000 or more miles resulted in a projection or protuberance around the pin hole 22 on the inboard surface 17 of the outboard pocket wall 18 and sometimes a protuberance in the form of a ledge at the bottom of that wall. Such protuberances appear to be formed as a result of the rubbing action of the edges about the pin hole O of the friction shoe S and the lower edges E of the shoe sidewall. The projection and ledge of such prior art structures maybe of such magnitude so as to prevent retraction of the shoe S into the pocket during oscillation between the side frame and bolster with associated forces, which by design are to be withstood by the bolster along side wall areas 26 of the bolster. Such forces may be transmitted by the shoe S to the bolster along wedge wall 14 and outboard side wall 18.

According to the invention, pin hole 22 is located within a recess or relieved section 30 formed in the inner planar face 17 of the outboard pocket wall 18 for the purpose of preventing the edge about the enlarged pin hole in the friction shoe from forming a protrusion of metal around the pin hole 22. Also a recess or relieved section is formed at 32 along the bottom of wall 18 of the pocket to prevent formation of a protrusion in that area which is a continuation of the inner planar face 17. Heretofore, a protrusion has been formed by the lower edge of the friction shoe. Moreover the inner end of the friction shoe pocket is relieved or recessed at 34 and 36 (FIGS. 2 and 3) below the wedge wall 14 to ensure that the shoe will fully retract into the pocket under a force acting on the shoe, thereby ensuring that the force is withstood by the bolster surface 26 (FIG. 2), as designed, and against mating surfaces (not shown) of the side frame according to prior art practice.

It should be noted that the inner face 17 of pocket wall 18 defines a pad around the recess 30 to prevent contact between the friction shoe and the pocket wall 18 within the recess 30 during service conditions wherein the shoe oscillates against the inner face 17 of the pocket wall 18 as the bolster oscillates between the side frame columns.

Figure 5:
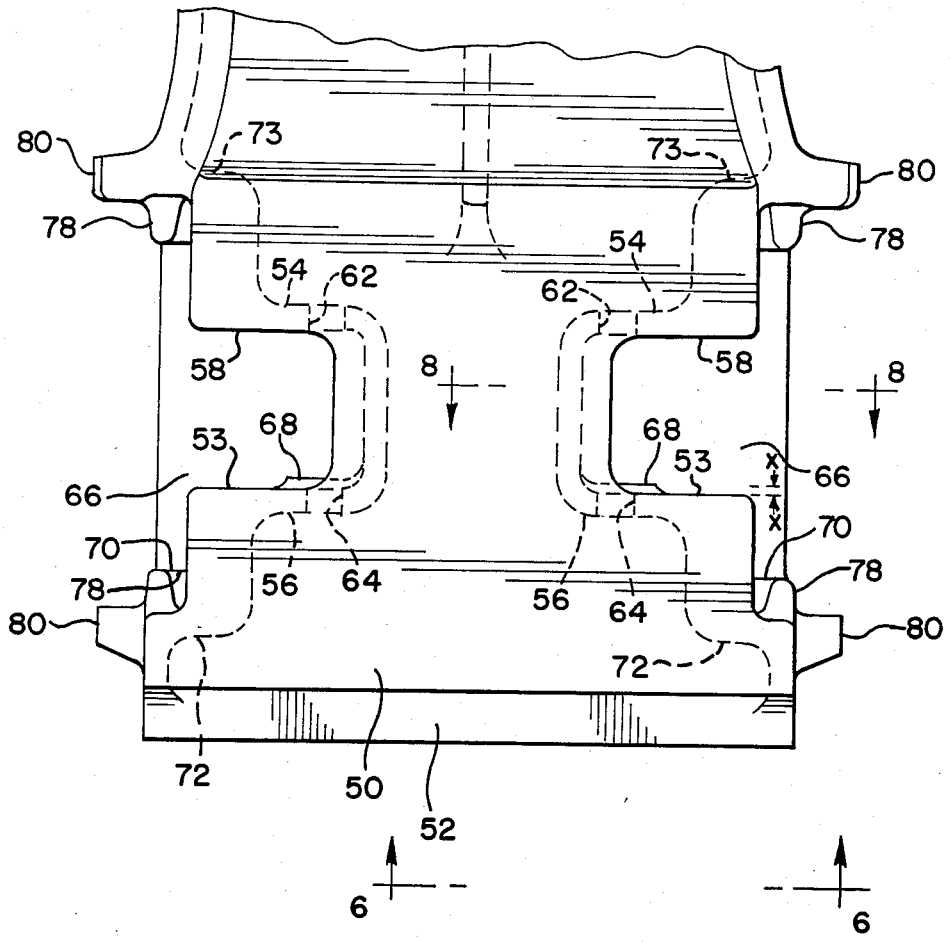
FIG. 5 is a top plan view of a constant friction bolster embodying another form of the invention.
Figure 6:
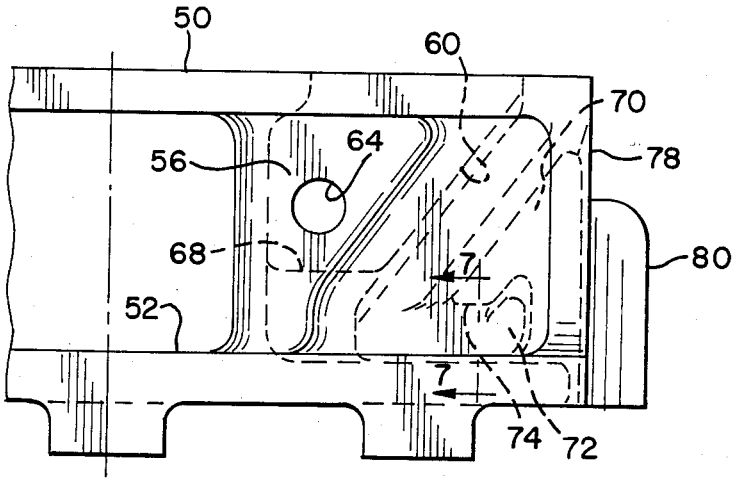
FIG. 6 is a fragmentary end elevational view taken on line 6—6 of FIG. 5.
Figure 7:
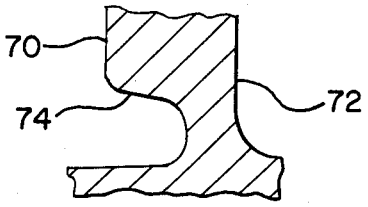
FIG. 7 is a sectional view on line 7—7 of FIG. 6.
Figure 8:
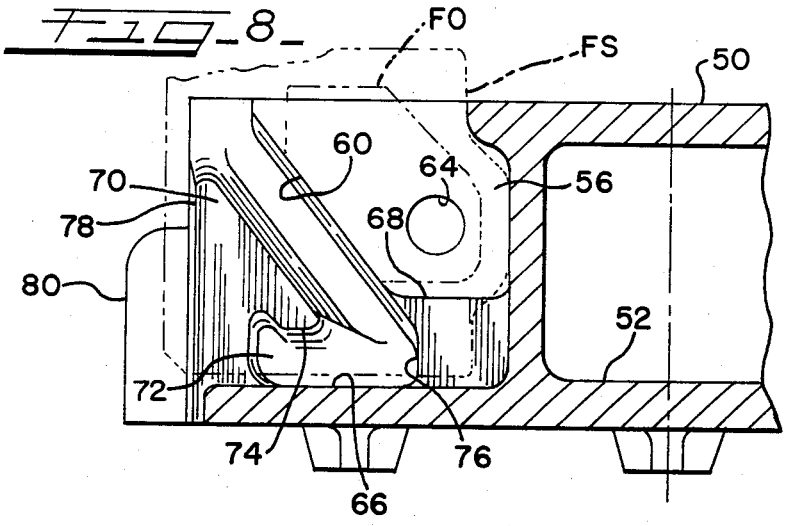
FIG. 8 is a sectional view taken generally along the line 8—8 of FIG. 5 and showing a friction shoe in phantom mounted therein.

Referring now to FIGS. 5 and 6 which show the invention as applied to a constant friction bolster having top and bottom walls 50 and 52 and spaced depending inboard walls 54 and 73 and outboard walls 56 and 72 defining a friction shoe pocket containing spaced inboard and outboard pocket wedge walls 60 (FIGS. 6 and 8). The inboard and outboard walls 54 and 56 are formed with substantially planar inner faces 58 and 68 respectively. The walls 54 and 56 have pin holes 62 and 64, respectively, for a pin (not shown) serving a purpose heretofore described in connection with FIGS. 1–4. The pocket of FIGS. 5 and 8 comprises a bottom wall spring seat 66 extending between each pair of inboard walls 54 and 73 and outboard walls 56 and 72 to support a spring (not shown) which urges a friction shoe FS under substantially constant pressure against the wedge walls 60 during relative vertical movement between the bolster and a side frame (not shown) which has columns with friction surfaces engaged by the respective shoes in the usual manner.

In FIG. 5, it will be seen that an area 53 of the outboard bolster wall 56 surrounding the pinhole 64 has been relieved or recessed an increment below the planar face 68 so that the shoe FS seated against the wall 56 does not rub near the pinhole 64 but rubs against the face 68 thereby preventing shoe contact and wear around the pin hole FO as the shoe moves in service relative to the friction shoe pocket. Such shoe movement, as heretofore described results from oscillation of the bolster between side frame columns, with the shoe engaged with the outboard pocket wall.

Another planar face 70 is formed on the inside of an outboard pocket wall 72. This planar face 70 is somewhat triangular in shape as seen in elevational view at the left of FIG. 8 with the apex of the triangle at the top of the face 70, the lower edge of which is relieved or notched as at 74 so that the shoe during bolster oscillation such as heretofore described rubs against the pad 70 across the relief 74 thereby avoiding formation of a ledge at the base of the outboard pocket wall 72, as best seen in FIGS. 6 (right) and 7, although the relief 74 is known in the prior art. The inner surfaces 68 and 70 are substantially parallel insofar as this is possible under manufacturing tolerances, so that the shoe will not cant against the surface 68 on a substantially vertical axis. This ensures substantially flat face engagement at 68 and 70 with the shoe, with the pin hole 64 recessed outboardly from the pad 68.

Referring now to FIG. 8, it will be seen that the inner end of each friction shoe pocket is shaped to ensure that a force imposed by the side frame urging the shoe into a retracted position within the pocket may cause its full retraction so that such force may be transmitted to the bolster at surfaces 78 which are designed to withstand such forces without excessive stresses.

What is claimed is:

1. A railway truck friction shoe pocket for accommodating a friction shoe therein, said friction shoe pocket comprising a sloping wedge wall providing a wedge seat for the friction shoe, a first lateral wall depending from said wedge wall, a second lateral wall spaced from said first lateral wall and depending from said wedge wall, each of said lateral walls having planar inner faces adapted to engage planar faces on the friction shoe, the friction shoe having an opening on either sidewall thereof, at least one of said planar inner faces on said lateral walls being provided with a recess, said recess including a pinhole and said recess is positioned to allow an edge of said opening in the friction shoe sidewall to slidingly engage the planar inner face of the lateral wall projecting beyond said relieved section thereby preventing the formation of protuberances projecting perpendicularly from the lateral walls of the friction shoe pocket due to wearing away of areas surrounding the pinhole on the planar faces.

2. The invention as defined in claim 1 wherein at least one of said inner faces is provided with a recessed section along the lower edge of the lateral wall adjacent the limit of movement of the friction shoe to prevent the formation of protuberances along said lower edge due to wearing away of the surrounding areas of the planar face.

* * * * *

UNITED STATES PATENT AND TRADEMARK OFFICE

CERTIFICATE OF CORRECTION

PATENT NO. : 4,637,319

DATED : January 20, 1987

INVENTOR(S) : Charles Moehling et al

It is certified that error appears in the above-identified patent and that said Letters Patent is hereby corrected as shown below:

Claim 1, column 4, line 56, "relieved section" should read --recess--;

Claim 1, column 4, line 60, after "planar" insert --inner--.

Claim 2, column 4, line 62, after "said" insert --planar--.

Claim 2, column 4, line 66, after "planar" insert --inner--.

Signed and Sealed this

Fourth Day of July, 1989

*Attest:*

*Attesting Officer*

DONALD J. QUIGG

*Commissioner of Patents and Trademarks*